US005815787A

United States Patent [19]

Crayton et al.

[11] Patent Number: 5,815,787

[45] Date of Patent: Sep. 29, 1998

[54] CASSETTE TRAY ASSEMBLY FOR FEEDING SHEETS OF DIFFERENT BASIS WEIGHT

[75] Inventors: Bruce E. Crayton, Rochester; Hector J. Sanchez, Webster, both of N.Y.

[73] Assignee: Xerox Corporation, Stamford, Conn.

[21] Appl. No.: 970,838

[22] Filed: Nov. 14, 1997

[51] Int. Cl.[6] ..... G03G 15/00

[52] U.S. Cl. ..... 399/393; 271/160; 271/171

[58] Field of Search ..... 399/393, 389; 271/148, 157, 158, 160, 171

[56] References Cited

U.S. PATENT DOCUMENTS

| | | | |
|---|---|---|---|
| 4,786,042 | 11/1988 | Stemmle | 271/9.1 |
| 5,085,421 | 2/1992 | Sellers | 271/157 X |
| 5,338,021 | 8/1994 | Shirai | 271/160 X |
| 5,419,544 | 5/1995 | Ono et al. | 271/160 X |
| 5,632,477 | 5/1997 | Morinaga | 271/171 X |
| 5,752,696 | 5/1998 | Nakatani et al. | 271/157 X |
| 5,758,250 | 5/1998 | Miki | 399/393 |

*Primary Examiner*—Matthew S. Smith

*Attorney, Agent, or Firm*—Tallam I. Nguti

[57] ABSTRACT

A sheet stacking and lifting cassette tray assembly for reliably and effectively feeding sheets of different basis weight for use in a reproduction machine. The sheet stacking and lifting cassette tray assembly includes a cassette frame including a frame floor, and frame side walls; a plurality of sheet stacking and lifting subassemblies mounted within, and to, the frame side walls for applying selectable values of sheet lifting normal forces against a sheet feedhead. Each sheet stacking and lifting subassembly of the plurality of sheet stacking and lifting subassemblies includes a pivotable stacking and supporting plate, and a set of springs having a spring rate for providing a normal force having a particular value for lifting a stack of sheets. The sheet stacking and lifting cassette tray assembly also includes a selecting device for engaging a first number of the plurality of sheet stacking and lifting subassemblies so as to prevent the first number of the plurality of sheet stacking and lifting subassemblies from applying a normal force for lifting, thus varying a number of the sheet stacking and lifting subassemblies applying a normal force to a stack of sheets of a given basis weight, and thereby enabling reliable and effective feeding of sheets from such stack without sheet feeding miscues.

6 Claims, 5 Drawing Sheets

CASSETTE TRAY ASSEMBLY FOR FEEDING SHEETS OF DIFFERENT BASIS WEIGHT

BACKGROUND

This invention relates to electrostatographic reproduction machines, and more particularly to a frameless compact electrostatographic reproduction machine having framed mutually aligning modules for enabling quick non-specialized tools assembly and disassembly of the machine. Specifically the invention is directed to a separately framed cassette tray assembly module in such machine for reliably and effectively feeding sheets of different basis weight.

Generally, the process of electrostatographic reproduction includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image. The copy sheet typically is fed from a copy sheet supply that can be an elaborate and expensive elevator assembly, or a relatively less costly cassette tray assembly, for example, a forward feed buckle cassette tray assembly.

One of the challenges encountered in the design of a forward buckle sheet or paper feed cassette tray assembly having a spring-loaded pivoting plate for positioning a sheet to be fed against sheet feed rolls, is how to maintain the sheet feeding normal force within a proper operating range for reliably feeding sheets of different sizes used in the cassette tray assembly.

Conventionally, a typical forward buckle cassette tray assembly of the type utilizes a single pivoting plate that holds a stack of sheets. The single pivoting plate is liftable by a set of one or more springs into a sheet feeding position against a set of sheet feed rolls. The set of springs thus provides a normal force required for separating a sheet to be fed from the stack. In order to achieve reliable sheet feeding, the normal force required must be within a predetermined range. Too little a normal force will result in misfeeds or late feeds, while too much of a normal force can cause multiple sheet feeds, sheet jams and sheet damage.

Usually most cassette trays are simply optimized for the most common paper size and basis weight (i.e. 8.5"×11", 20#) paper, in which case the customer is forced to accept less than optimum performance when attempting to feed papers of a significantly different size and basis weight, for example 8.5×5.5" or statement size, 20# paper. Situations of this type can become a serious problem if the customer's usage for example of such statement size papers increases. A typical and undesirable response might be calling a service technician to visit the customer and attempt to change the lift springs to those of a different force value in order to optimize the tray for statement size paper.

Ordinarily, sheet cassette tray assemblies are designed for producing a constant normal force by attempting to match the normal force it applies to a stack of sheets as the stack of sheets is depleted from a full tray state, to and empty tray state. Such attempts for example include attempting to match the linear density of a stack of paper or sheets (of a given size and basis weight) to the force rate of the springs used in lifting the stack. By doing so, it is possible to maintain a fairly constant normal force on the stack as sheets of paper (of the type designed for) are depleted from a full tray condition to an empty tray condition. If such a constant normal force is actually attained, then the cassette tray assembly is said to have been optimized for that particular type of paper.

However, when a paper of a significantly different size and basis weight, that is, a paper with a significantly different linear density from the one for which the system is optimized, the normal force on the feed rolls ordinarily will vary, resulting in sheet misfeeding or sheet multifeeding, depending on whether the linear density is higher or lower than that for which the system is optimized.

The linear density of a stack of paper is defined as the weight in grams per millimeter of thickness of the stack of paper of a given size and basis weight. Some existing designs cassette tray assemblies have attempted to address this force variation problem by optimizing the design to one size and basis weight of paper, and then limiting the type, or number of sheets of such paper that can be fed reliably from the tray at any time. In such cases, users wanting to feed a stack of papers of a significantly different size and basis weight, ordinarily would have to switch cassette trays or use a different paper tray in the machine. In some cases, customers are forced to resort to machines that use expensive stack elevating devices in an attempt to reduce or control the normal force variation for the different types of papers.

There is therefore a need for a single, economical cassette tray assembly that can reliably and effectively feed more than one size and basis weight of paper by automatically changing the sheet feeding normal force of the cassette tray from one type paper to the other.

SUMMARY OF THE INVENTION

In accordance with the present invention, there is provided a sheet stacking and lifting cassette tray assembly for reliably and effectively feeding sheets of different basis weight for use in a reproduction machine. The sheet stacking and lifting cassette tray assembly includes a cassette frame including a frame floor, and frame side walls; a plurality of sheet stacking and lifting subassemblies mounted within, and to, the frame side walls for applying selectable values of sheet lifting normal forces against a sheet feedhead. Each sheet stacking and lifting subassembly of the plurality of sheet stacking and lifting subassemblies includes a pivotable stacking and supporting plate, and a set of springs having a spring rate for providing a normal force having a particular value for lifting a stack of sheets. The sheet stacking and lifting cassette tray assembly also includes a selecting device for engaging a first number of the plurality of sheet stacking and lifting subassemblies so as to prevent the first number of the plurality of sheet stacking and lifting subassemblies from applying a normal force for lifting, thus varying a number of the sheet stacking and lifting subassemblies applying a normal force to a stack of sheets of a given basis weight, and thereby enabling reliable and effective feeding of sheets from such stack without sheet feeding miscues.

BRIEF DESCRIPTION OF THE DRAWINGS

In the detailed description of the invention presented below, reference is made to the drawings,in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
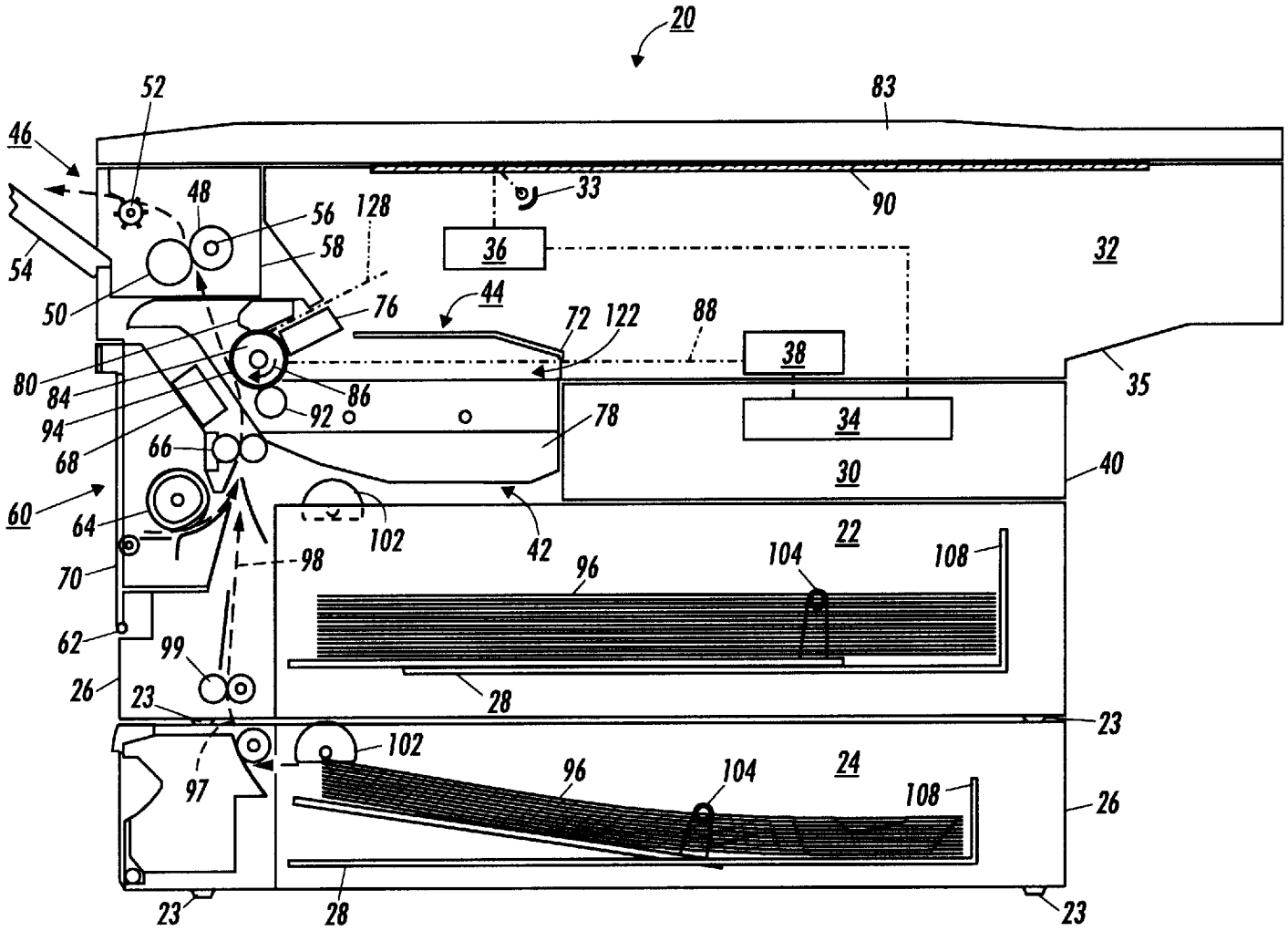
FIG. 1 is a vertical schematic of an exemplary frameless compact electrostatographic reproduction machine comprising separately framed mutually aligning modules in accordance with the present invention.
Figure 2:
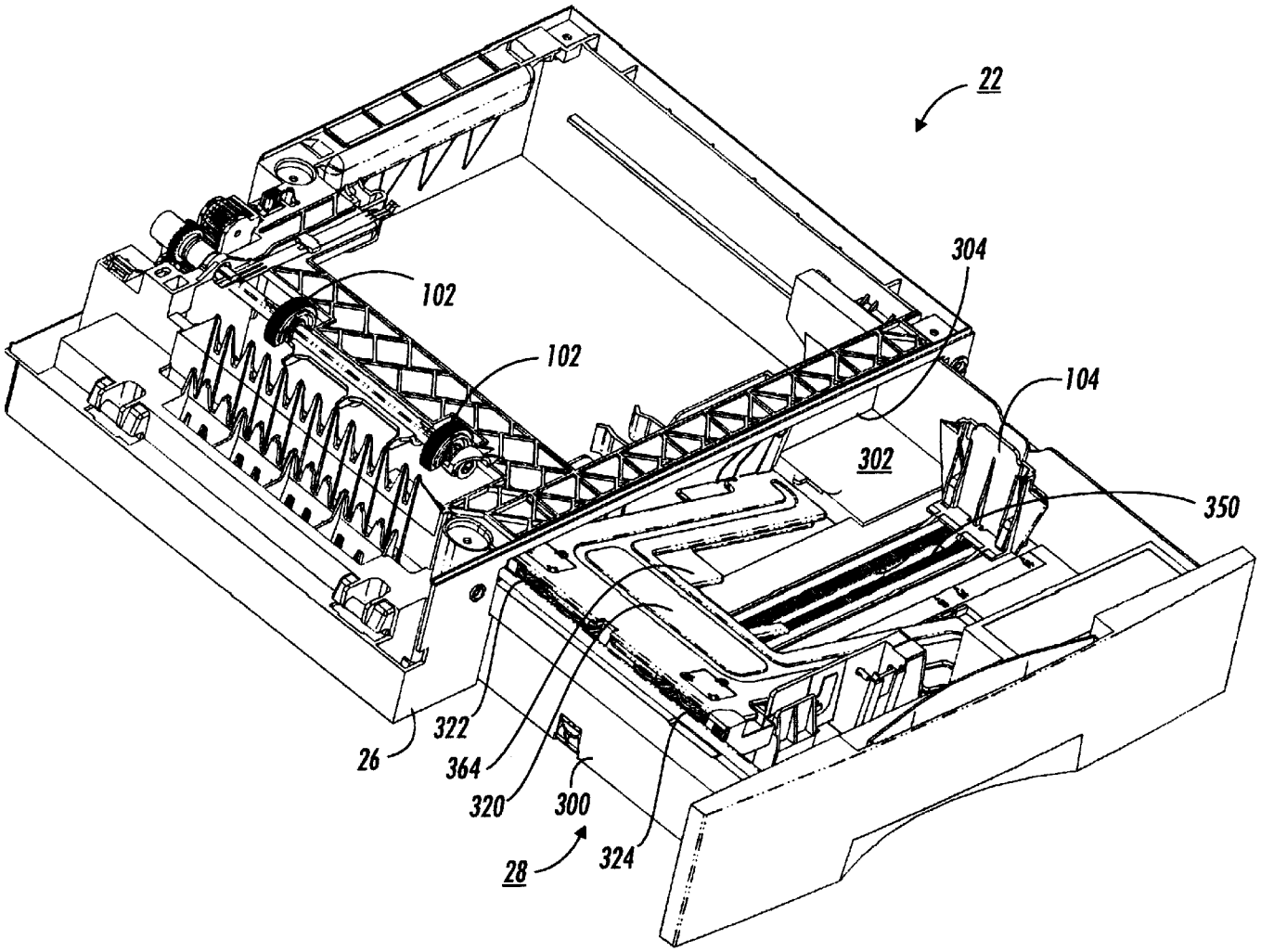
FIG. 2 is a perspective view of the copy sheet input module of the machine of FIG. 1 showing its cassette tray assembly in an out-position.
Figure 3:
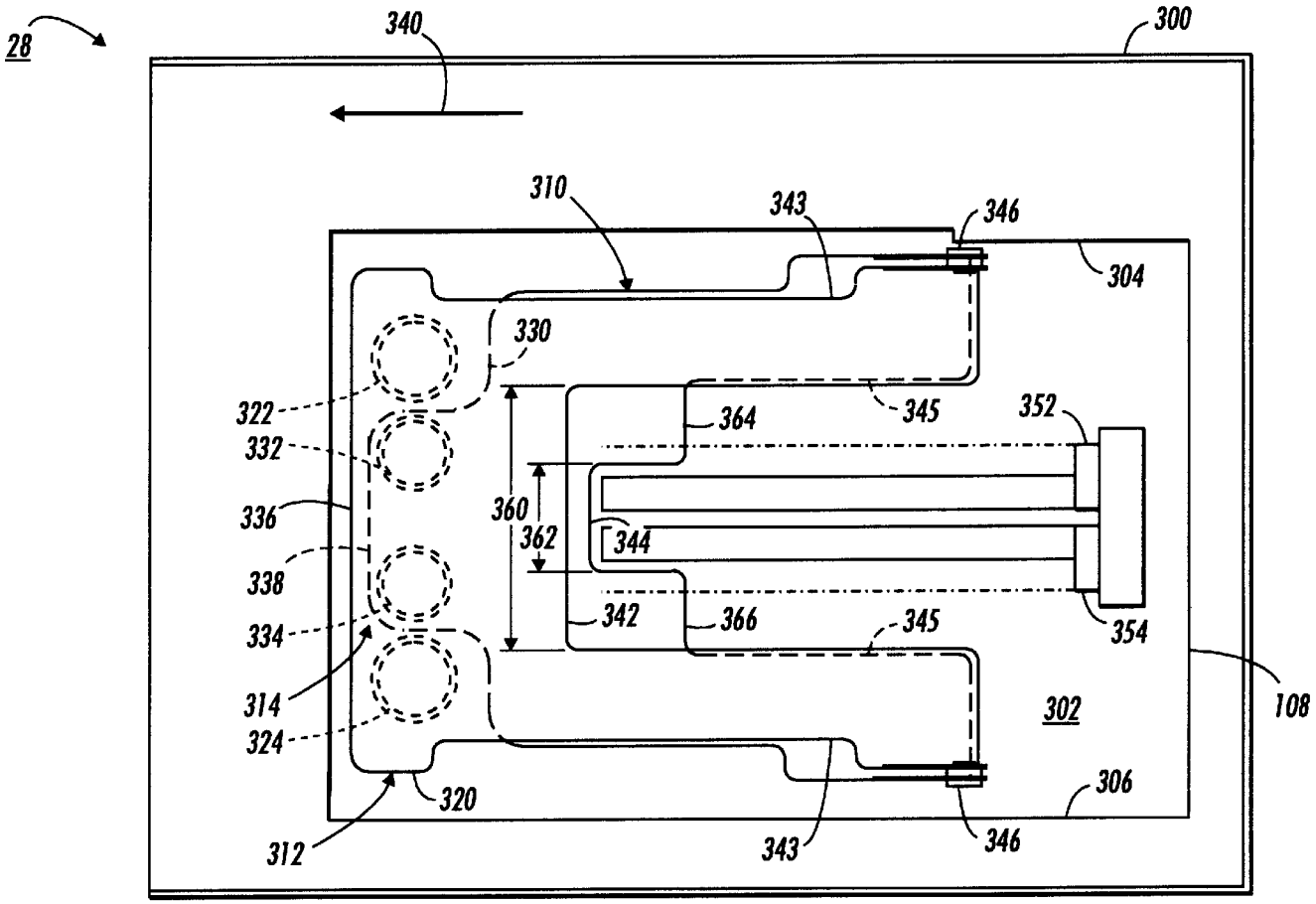
FIG. 3 is a top illustration of the multiple sheet supporting and lifting subassemblies of the cassette tray assembly of FIG. 2.
Figure 4:
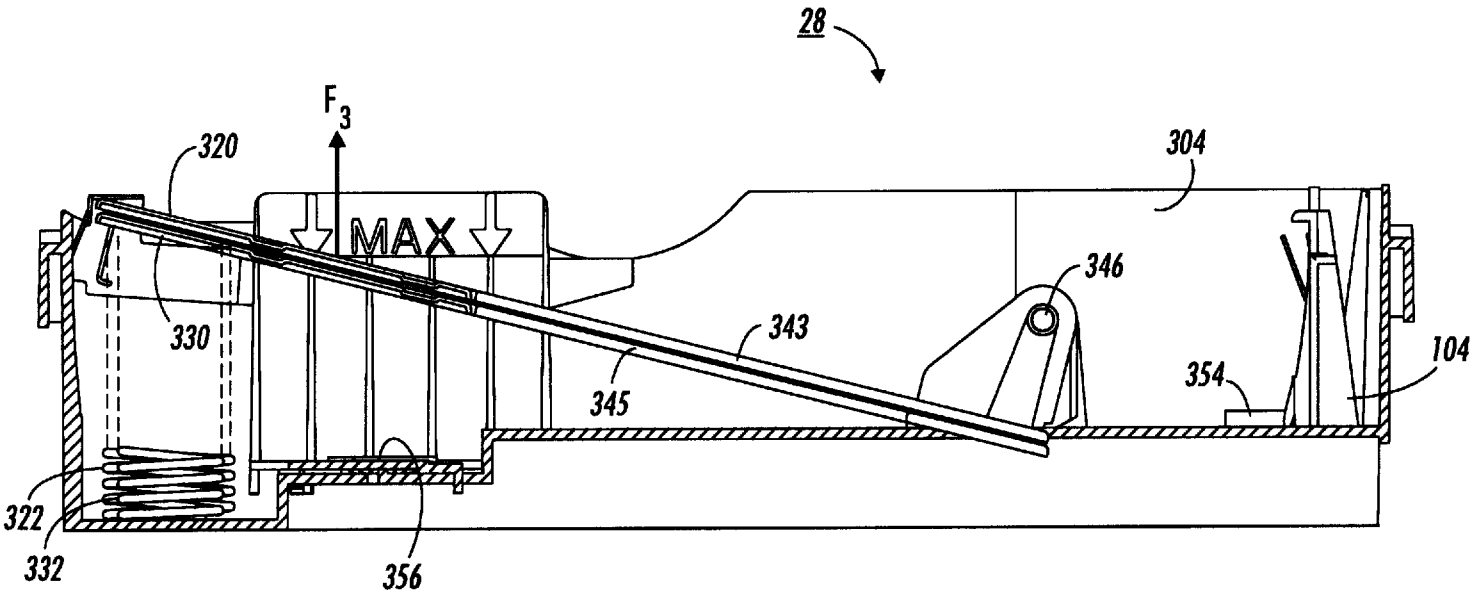
FIG. 4 is a sectional illustration of the cassette tray assembly of FIG. 2 with both sheet supporting plates thereof in an up position.

Referring now to FIGS. 1 and 2, there is illustrated a frameless exemplary compact electrostatographic reproduction machine 20 comprising separately framed mutually aligning modules, including such a separately framed copy input module according to the present invention. The compact machine 20 is frameless, meaning that it does not have a separate machine frame to which electrostatographic process subsystems are assembled, aligned to the frame, and then aligned relative to one another as is typically the case in conventional machines. Instead, the architecture of the compact machine 20 is comprised of a number of individually framed, and mutually aligning machine modules that variously include pre-aligned electrostatographic active process subsystems.

As shown, the frameless machine 20 comprises at least a framed copy sheet input module (CIM) 22 in accordance with the present invention (to be described in detail below). Preferably, the machine 20 comprises a pair of such copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame or housing 26 with external covers, and a copy sheet stacking and lifting cassette tray assembly 28 that is slidably movable in and out relative to the module frame 26, in order to enable its reloading with sheets of the paper. When as preferred here, the machine 20 includes two copy sheet input modules, the very base module is considered the auxiliary module (the ACIM), and the top module which mounts and mutually aligns against the base module is considered the primary module (the CIM).

Generally, the sheet stacking and lifting cassette tray assembly 28 includes a D-shaped feedhead roller 102, and an adjustable sheet dimension guide member 104 for holding a stack of sheets 96 in alignment. As pointed out above, the module frame 26 includes an external or outer cover, and thus serves as a covered base portion of the machine 20. As further shown, the ACIM 24 further comprises sheet path extension portion 97 to a sheet path 98, that includes sheet advancing rollers 99 for advancing sheets fed from the ACIM 24 to a common set of registration rollers 66. The registration rollers then supply registered sheets 96 from the CIM 22 and ACIM 24 to an image transfer point 94 on a photoreceptor or drum 84.

The main and auxiliary copy input sheet modules 22, 24 and the associated paper path extension 97 advantageously allows a "load-while-running" ability, meaning that an operator is able to load paper into one of them, while a job is running with paper being fed out of the other. The D-shaped forward buckle feedhead roller 102 of each copy input module is energized via a solenoid (not shown) that is activated by a single revolution clutch (not shown), and is driven by a drive module (not shown) of the machine 20. Each revolution of the D-shaped feedhead roller 102 corresponds to one sheet of paper being fed.

The machine 20 next comprises a framed electronic control and power supply (ECS/PS) module 30 in accordance with the present invention (to be described in detail below). As shown, the ECS/PS module mounts onto, and is mutually aligned against the CIM 22 (which preferably is the top or only copy sheet input module). The ECS/PS module 30 includes all controls and power supplies (to be described below) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. Importantly, the ECS/IPS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The machine 20 also comprises the separately framed imager module 32, which mounts over, and mutually aligns against the ECS/PS module 30. As shown, the RIS 36, the ROS 38, a light source 33, and an imager module frame 35 comprise the imager module 32. The RIS 36 preferably is a full rate/half rate scanner with imaging optics and a CCD array (not shown separately), for converting hard copy images to electronic bit maps or digitized images. The imager module 32 includes electrical connection means (not shown) connecting the RIS 36 to an image processing unit (IPP) 34 for processing the digitized images. The imager module 32 has a platen 90 and a top cover 83. In accordance with the present invention, the imager module module frame 35 (to which the RIS 36 and ROS 38 are assembled), forms a covered portion of the machine 20 upon assembly, as well as locates to, mutually aligns with, and mounts to the ECS/PS module 30, and the other adjoining modules.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32. The CRU or process cartridge module 44 generally comprises a module housing subassembly 72, a photoreceptor 84 rotatable in the direction of the arrow 86, a charging subassembly 76, a developer subassembly 78 including a developer roil 92, a cleaning subassembly 80 for removing residual toner as waste toner from a surface of the photoreceptor, and a waste toner sump subassembly for storing waste toner. The module housing subassembly 72 of the CRU or process cartridge module 44 importantly includes a first path 122 for receiving a ROS beam 88 onto the photoreceptor 84, and a second path for receiving an erase light 128 onto the photoreceptor.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles(not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine 20 then includes an active component framed door module 60, which is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The Door module 60 comprises active components including a bypass feeder assembly 64, sheet registration rolls 66, toner image transfer and detack devices 68, and the fused image output or exit tray 54. The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46. The door module 60 is mounted pivotably to the CIM 22 at a pivot 62, such that it is openable for providing access to a portion of the copy paper path 98 (jam clearance) and to the process cartridge module 44 (cartridge removal and replacement).

Referring now to FIGS. 1–5, the copy input module (CIM, ACIM) 22, 24 each includes a copy sheet stacking and lifting cassette tray assembly 28 that is mounted slidably to a module frame 26. In accordance with the present invention, the sheet stacking and lifting cassette tray assembly 28 includes a cassette tray frame 300 having a frame floor 302, frame side walls 304, 306 and a rear end wall (not labeled). Importantly, the sheet stacking and lifting cassette tray assembly 28 includes a selectable plurality, shown generally as 310, of sheet stacking and lifting subassemblies mounted within the cassette tray frame 300 for holding and efficiently lifting stacks of sheets 96 of different basis weight, or of different sizes and hence different weights. For example, the plurality 310 of sheet stacking and lifting subassemblies may include a main sheet stacking and lifting subassembly 312, and at least one auxiliary sheet stacking and lifting subassembly 314.

The main sheet stacking and lifting subassembly 312, as shown, includes a main stack supporting plate 320, and a first set of springs 322, 324 having a first spring rate R1, and connected to the cassette frame floor 302 and to the main stack supporting plate 320, for providing a first stack lifting force, and hence a first normal force F1 against the feedhead roll 102 (FIG. 1) for feeding sheets from such stack. The at least one auxiliary sheet stacking and lifting assembly 314 includes an auxiliary stack supporting plate 330. The auxiliary stack supporting plate 330 as shown, is located above the cassette frame floor 302, and below the stack supporting plate 320. The at least one auxiliary sheet stacking and lifting assembly 314 also includes a second set of springs 332, 334 that have a second spring rate R2 and are connected to the cassette frame floor 302 and to the auxiliary stack supporting plate 330, for providing an auxiliary stack lifting force F2 to the first stack lifting force F1 of the main sheet stacking and lifting subassembly 312 to lift a stack of sheets on the main stack supporting plate 320. The main and the at least one auxiliary sheet stacking and lifting assemblies 312, 314 thus together provide a compound and different normal force F3 (F1+F2) against the feedhead roll 102 for feeding sheets from a stack being lifted by both assemblies 312, 314.

As illustrated, each of the main and the auxiliary stack supporting plates 320, 330, each has a front end 336, 338, respectively relative to a direction 340 of sheet feed, and each has rear end 342, 344 respectively. The rear end 342, 344 of each plate is mounted pivotably to each cassette frame side wall 304, 306, and preferably at a common pivot 346 on such wall. Their respective sets of springs 322, 324 and 332, 334 are connected to the front end 336, 338 respectively of each stack supporting plate 320, 330. Preferably, the front end 336 of the main stack supporting plate 320 as shown (FIG. 3) is wider than that 338 of the at least one auxiliary stack supporting plate 330. This difference in width advantageously allows for the first set of springs 322, 324 of the main sheet stacking and lifting subassembly 312 to be located to the outside, on each side of the at least one auxiliary stack supporting plate 330. The second set of springs 332, 334 as connected to the front end 338 of the at least one auxiliary stack supporting plate 330, are therefore located to the inside, on each side, of the first set of springs 322, 324, thus allowing free up and down movement of the main sheet stacking and lifting subassembly 312, independently of the at least one auxiliary sheet stacking and lifting subassembly 314.

The cassette frame floor 302 as shown importantly includes a slot 350 for slidably enabling movement of a sheet dimension adjusting guide, for example a sheet length guide 104 (FIG. 1) for aligning sheets in a stack against the feedhead roll 102. Although the slot 350 is shown running longitudinally from back to front (relative to the direction 340 of sheet feed, it equally could run from side to side (304 to 306) where sheets of different widths for example, are being used. The slidable sheet length guide 104 acts advanatageously as an automatic sheet lifting force selecting device for selecting, for example, between F1 and F3. As shown, the selecting device or sheet length guide 104 includes plate selection tabs 352, 354 formed thereon for riding over each side of the slot 350 as the device or sheet length guide 104 is moved back and forth through the slot 350.

Figure 5:
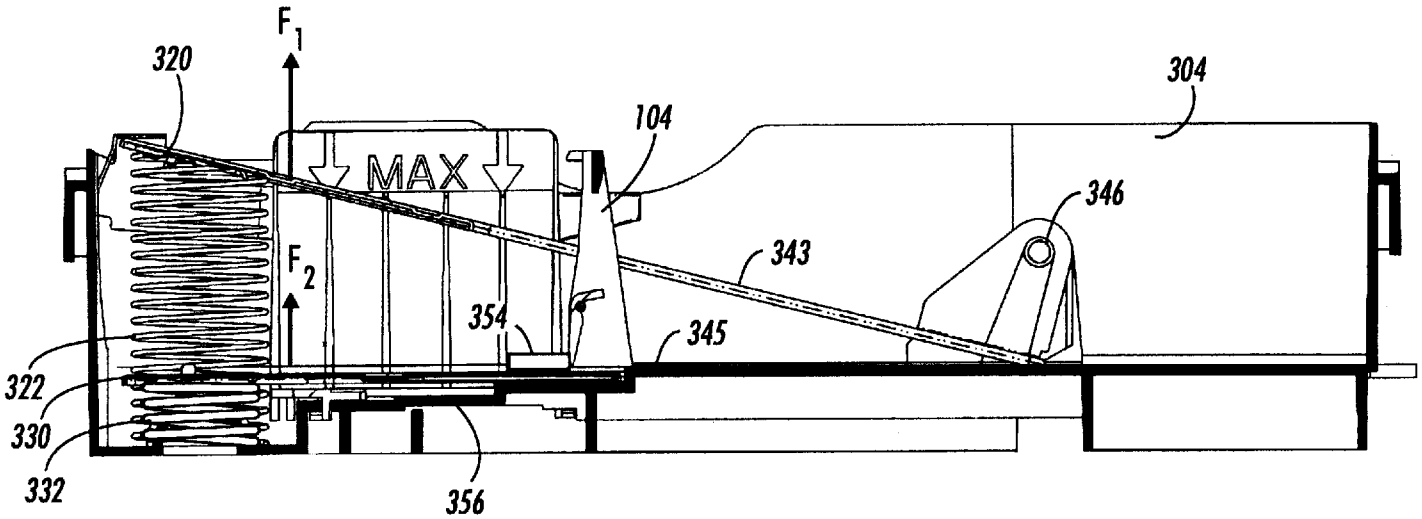
FIG. 5 is a sectional illustration of the cassette tray assembly of FIG. 2 with only the main sheet supporting plate thereof in the up position, in accordance with the present invention.

The cassette frame floor 302 also includes at least one stepped recess 356 having a depth at least equal to or greater than a thickness of the at least one sheet stack supporting plate 330, for receiving such plate 330, into a down and locked or held position (FIG. 5). The recess 356 as such also has an area (length×width) that is equal to or slightly greater than an area of the at least one auxiliary stack supporting plate 330, in order to provide an even stack supporting surface within the cassette frame 300, even when the auxiliary stack supporting plate 330 is being held down as above. As further shown, the rear end 342 of the main stack supporting plate 320 includes a first center cutout 360 that is centered over the slot 350 for allowing the length guide 104 to move freely frontwards and backwards. The rear end 344 of the at least one auxiliary stack supporting plate 330 similarly includes a second center cutout 362 that is centered over the slot 350, and that is narrower than the first center cutout 360 of the main stack supporting plate 320. As a result, when the auxiliary stack supporting plate 330 is in the down position, rear, inward wing portions 364, 366 of the auxiliary stack supporting plate 330 are exposed along side the slot 350, and are available for engagement by the tabs 352, 354 of the length guide 104, when the length guide 104 is slidably moved over such rear wing portions 364, 366.

In accordance with another aspect of the present invention, the a module frame 26 for example of the auxiliary copy input module 24, importantly serves as a base portion for the machine 20, and provides a covered portion of the machine 20 at such base. As shown in FIG. 2, the sheet stacking and lifting cassette tray assembly 28 thereof is slidably mounted to, and for movement into and out of, the module frame 26 so as to enable reloading of such cassette tray assembly with new and or different sheets of paper.

In operation, the plurality 310, including the main and the at least one sheet stacking and lifting subassemblies 312, 314 (and comprising the main and auxiliary stack supporting plates 320, 330 and the sets of springs 322, 324, and 332, 334) are used for stacking and efficiently lifting a first type of sheets having a first basis weight, for example, long sheets such as letter size (8.5"×11") or legal size sheets (8.5"×14") of a given basis weight (e.g 20#). On the other hand, for stacking and efficiently lifting a second type or size of such sheets, for example, statement size (8.5"×5.5") sheets, only the main stacking and lifting subassembly 312 (comprising the main stack supporting plate 320 and the first set of springs 322, 324) is used for efficiently lifting such a stack of short sheets having a different weight for the same number of sheets, or for the same stack height of sheets being fed. As shown, moving the length guide 104 from an 11 inch sheet length position (FIG. 4) into the 5.5 inch sheet length position (FIG. 5) causes the plate selection tabs 352, 354 to automatically ride over, engage and hold down the winged portions 362, 364 of the auxiliary stack supporting plate 330 along with the second set of springs 332, 334.

Thus this invention uses two selectable sheet stacking and lifting subassemblies 312, 314, each including a stack supporting plates 320, 330 and a set of springs 322, 324 and 332, 334 for efficiently lifting stacks of sheets. The invention essentially provides automatic optimization for at least two different type paper sizes in a forward buckle feeding type cassette tray assembly. However, the design is not limited to two plates and two sets of springs, since more, for example "n" plates and "n" sets of springs can be used in a similar fashion, depending on the number of different types of paper for which the feeder is to be optimized. Accordingly there will be "n" recesses in the floor 302 for receiving "n" stack supporting plates. The two different types of paper for which the present invention is optimized are 8.5"×5.5", 20# paper to be fed long edge first, and 8.5"×11", 20# paper to be fed short edge first.

It was found for example that the spring constant required for optimizing the sheet stacking and lifting cassette tray assembly 28 of the present invention is 18.32 gms/mm when running 8.5"×5.5", 20# paper, while that for running 8.5"×11", 20# is 24.42 gms/mm. The desired operating range for the normal force was 300–500 gms., with an initial, tray-empty value of 350 gms. The top or main stack supporting plate 320 with its two supporting springs 322 and 324 were used alone or by themselves (by holding down the auxiliary plate 330 and its springs 332, 334) to lift the small paper, namely 8.5"×5.5" against the feed rolls 102, therefore the springs used to accomplish this had a combined rate (R1) of 18.32 gms/mm. The bottom or auxiliary plate 330 with its two supporting springs 332, 334 were used to provide the additional support required to bring the sheet stacking and lifting cassette tray assembly 28 of the present invention spring rate (R1+R2) to a value of 24.42 gms/mm, which then enabled the tray assembly 28 to feed the larger paper, namely 8.5"×11". In other words, the rate R2 for the springs 332, 334 supporting the auxiliary plate 330 must be 6.10 gms/mm (24.42−18.32=6.10 gms/mm.), since they were added to that, R1 of the main plate 320 to provide a total rate of 24.42 gms/mm. Accordingly, the normal force for feeding the different size sheets would be expected to vary if, for example the larger papers were to be fed with the tray assembly 28 optimized only for the smaller size paper, and vice versa.

As mentioned previously, this changing of optimization for the tray assembly 28 from one paper size to another is accomplished automatically as the operator adjusts the length guide 104 to correspond with the size of the paper loaded in the tray. More specifically, when the tray is removed from the machine (FIG. 2) for refilling it with paper, both stack supporting plates 320, 330 preferably are first locked in a down position in order to enable easy loading of the paper. Then the operator slides the length guide 104 forwardly until it touches the stack of sheets just loaded. If the paper or sheets just loaded are the small size, 8.5"×5.5", the length guide 104 will be moved towards the front of the stack until it touches the stack of such short sheets. At this point, the tabs 352, 354 on the length guide 104 literally step over the auxiliary stack supporting plate 330, keeping it and its springs 332, 334 from being activated when the plates 320, 330 are released from the locked, down position. Thus, only the main stack supporting plate 320 and its springs 322, 324 are allowed to move upwards and provide the required normal force F1 to the stack of short sheets (FIG. 5). As the paper depletes from a full to an empty tray, the length guide 104 maintains the auxiliary plate 330 and its springs in the locked down position, thus keeping them from being actuated. If one were to change paper size and load the tray with the larger and therefore heavier stack of paper (8.5"×11" size), this will require the length guide 104 to be moved back to a position that will result in both the main and auxiliary lift plates 320, 330 and all four springs being activated. In this case, the required normal force is now F3 supplied by the four springs, 322, 324 and 332, 334.

Thus in accordance with the present invention, there is provided a sheet cassette tray assembly having plural, selectable, force applying devices for applying and maintaining an effective sheet feeding normal force, on a stack of sheets, within a proper operating range for reliable feeding of plural types of sheets in such stacks, each type of sheet having a different size and basis weight. The plural, selectable force applying devices include a first plate and spring assembly, and a second plate and spring assembly. The plural, selectable force applying devices also include automatic selection means for automatically changing the sheet feeding normal force when the cassette tray assembly is adjusted for example from one size sheets to another by adjusting a sheet dimension guide in the cassette tray. The cassette tray assembly is optimized for more than one size type or more than one weight type of sheets. The cassette tray assembly as such, thus can reliably and effectively increase the range of sheet sizes and basic paper weights for which the cassette tray operates reliably. The cassette tray as such can reliably handle greater than the conventional 250-sheet cassette volume without resort to costly elevator systems, or costly technical service adjustments.

As can be seen, there has been provided a sheet stacking and lifting cassette tray assembly for reliably and effectively feeding sheets of different basis weight for use in a reproduction machine. The sheet stacking and lifting cassette tray assembly includes a cassette frame including a frame floor, and frame side walls; a plurality of sheet stacking and lifting subassemblies mounted within, and to, the frame side walls for applying selectable values of sheet lifting normal forces against a sheet feedhead. Each sheet stacking and lifting subassembly of the plurality of sheet stacking and lifting subassemblies includes a pivotable stacking and supporting plate, and a set of springs having a spring rate for providing a normal force having a particular value for lifting a stack of sheets. The sheet stacking and lifting cassette tray assembly also includes a selecting device for engaging a first number of the plurality of sheet stacking and lifting subassemblies so as to prevent the first number of the plurality of sheet stacking and lifting subassemblies from applying a normal force for lifting, thus varying a number of the sheet stacking and lifting subassemblies applying a normal force to a stack of sheets of a given basis weight, and thereby enabling reliable and effective feeding of sheets from such stack without sheet feeding miscues.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

What is claimed is:

1. A sheet stacking and lifting cassette tray assembly for reliably and effectively feeding sheets of different basis weight for use in a reproduction machine, the sheet stacking and lifting cassette tray assembly comprising:

(i) a cassette frame including a frame floor, and frame side walls;

(ii) a plurality of sheet stacking and lifting subassemblies mounted within, and to, said frame side walls for applying selectable values of sheet lifting normal forces against a sheet feedhead, each sheet stacking and lifting subassembly of said plurality of sheet stacking and lifting subassemblies including a pivotable stacking and supporting plate, and a set of springs having a spring rate for providing a normal force having a particular value for lifting a stack of sheets; and (iii) a selecting device for engaging a first number of said plurality of sheet stacking and lifting subassemblies so as to prevent said first number of said plurality of sheet stacking and lifting subassemblies from applying a normal force for lifting thus varying a number of said sheet stacking and lifting subassemblies applying a normal force to a stack of sheets of a given basis weight, and thereby enabling reliable and effective feeding of sheets from such stack without sheet feeding miscues.

2. A copy sheet input module for holding and feeding copy sheets, the copy sheet input module comprising:

(a) a separate copy sheet input module frame for self aligning against a separate frame of an adjacent module in a reproduction machine, said separate copy sheet input module frame including an external cover forming part of an exterior of the reproduction machine; and (b) a sheet stacking and lifting cassette tray assembly mounted to said separate copy sheet input module frame for relative sliding movement, and for reliably and effectively feeding sheets of different basis weight, said cassette tray assembly including:

(i) a cassette frame including a frame floor, and frame side walls;

(ii) a plurality of sheet stacking and lifting subassemblies mounted within, and to, said cassette frame for applying selectable values of sheet lifting normal forces against a sheet feedhead, each sheet stacking and lifting subassembly of said plurality of sheet stacking and lifting subassemblies including a pivotable stacking and supporting plate, and a set of springs having a spring rate for providing a normal force for lifting a stack of sheets; and (iii) a selecting device for engaging a first number of said plurality of sheet stacking and lifting subassemblies so as to vary a number of said sheet stacking and lifting subassemblies applying a normal force to a stack of sheets of a given basis weight, thereby optimizing a resulting normal force applied for a particular type of sheet, and thus enabling reliable and effective feeding of such sheets without sheet feeding miscues.

3. The copy sheet input module of claim 2, wherein said frame floor includes a recess for receiving said first number of said plurality of sheet stacking and lifting subassemblies selected and engaged by said selecting device.

4. The copy sheet input module of claim 2, wherein said plurality of sheet stacking and lifting subassemblies comprises two sheet stacking and lifting subassemblies.

5. The copy sheet input module of claim 2, wherein said selecting device comprises a movable sheet dimension aligning guide member including tabs for engaging said first number of said plurality of sheet stacking and lifting subassemblies selected and engaged.

6. A compact electrostatographic reproduction machine, comprising:

(a) a platen for positioning a document sheet having an original image to be reproduced; and (b) a plurality of separately framed, mutually aligning machine modules variously containing electrostatographic process elements and subassemblies, said plurality of machine modules including a sheet stacking and lifting cassette tray assembly for reliably and effectively feeding sheets of different basis weight, said sheet stacking and lifting cassette tray assembly including:

(i) a cassette frame including a frame floor, and frame side walls;

(ii) a plurality of sheet stacking and lifting subassemblies mounted within, and to, said cassette frame for applying selectable values of sheet lifting normal forces against a sheet feedhead, each sheet stacking and lifting subassembly of said plurality of sheet stacking and lifting subassemblies including a pivotable stacking and supporting plate, and a set of springs having a spring rate for providing a normal force for lifting a stack of sheets; and (iii) a selecting device for engaging a first number of said plurality of sheet stacking and lifting subassemblies so as to vary a number of said sheet stacking and lifting subassemblies applying a normal force to a stack of sheets of a given basis weight, thereby optimizing a resulting normal force applied for a particular type of sheet, and thus enabling reliable and effective feeding of such sheets without sheet feeding miscues.

* * * * *